US011484181B2

(12) United States Patent
Ozertug et al.

(10) Patent No.: US 11,484,181 B2
(45) Date of Patent: Nov. 1, 2022

(54) INFORMATION LIGHT SYSTEM AND A DISHWASHER COMPRISING THE SAME

(71) Applicant: Vestel Beyaz Esya Sanayi ve Ticaret Anonim Sirketi, Manisa (TR)

(72) Inventors: Burak Ozertug, Manisa (TR); Abdulkadir Danismaz, Manisa (TR)

(73) Assignee: VESTEL BEYAZ ESYA SANAYI VE TICARET ANONIM SIRKETI, Manisa (TR)

( * ) Notice: Subject to any disclaimer, the term of this patent is extended or adjusted under 35 U.S.C. 154(b) by 141 days.

(21) Appl. No.: 16/987,758

(22) Filed: Aug. 7, 2020

(65) Prior Publication Data

US 2021/0038051 A1 Feb. 11, 2021

(30) Foreign Application Priority Data

Aug. 8, 2019 (TR) ..... 2019/12134

(51) Int. Cl.

| | |
|---|---|
| ***A47L 15/42*** | (2006.01) |
| ***A47L 15/00*** | (2006.01) |
| ***G08B 5/36*** | (2006.01) |

(52) U.S. Cl.

CPC ..... *A47L 15/4293* (2013.01); *A47L 15/0018* (2013.01); *A47L 15/4261* (2013.01); *G08B 5/36* (2013.01); *A47L 2501/26* (2013.01)

(58) Field of Classification Search

None

See application file for complete search history.

(56) References Cited

U.S. PATENT DOCUMENTS 9,161,675 B2 10/2015 Eng et al.

*Primary Examiner* — Rita P Adhlakha

(74) *Attorney, Agent, or Firm* — Steven M. Shape

(57) ABSTRACT

The present invention relates to an information light system to inform users about operating status of an electronic household appliance, especially a dishwasher, without opening a door of the household appliance, and a dishwasher comprising the same. The information light system (1) is characterized by comprising an electronic board (3) which has a lighting element (3*a*) thereon and adapted to communicate with a control unit of the dishwasher; a chamber (2) which comprises a first wall (2*a*) and two second walls (2*c*), wherein the chamber (2) is in the form of a housing suitable for placing the electronic board (3) and enables light to be reflected onto a second surface which is opposite to the first surface; a cover (2*b*) which covers at least partially the chamber (2) and comprises a reflecting area (2*f*) which is light-transparent, has a form focusing the light emitted from the lighting element (3*a*), and is located such that light emitted from the lighting element (3*a*) can reach, wherein a light focusing element is located on the reflecting area; a connector (4) for energising the electronic board (3) and which is located at the chamber (2); and a flap (5) which is located on the first wall (2*a*) and at an outer surface of the first fall (2*a*) not facing the chamber (2) so as to be at the same side with the connector (4), and is connected from a side to the chamber (2) in an inclined manner in such a way that it can direct the liquid coming to the chamber (2) away from the first wall (2*a*).

15 Claims, 7 Drawing Sheets

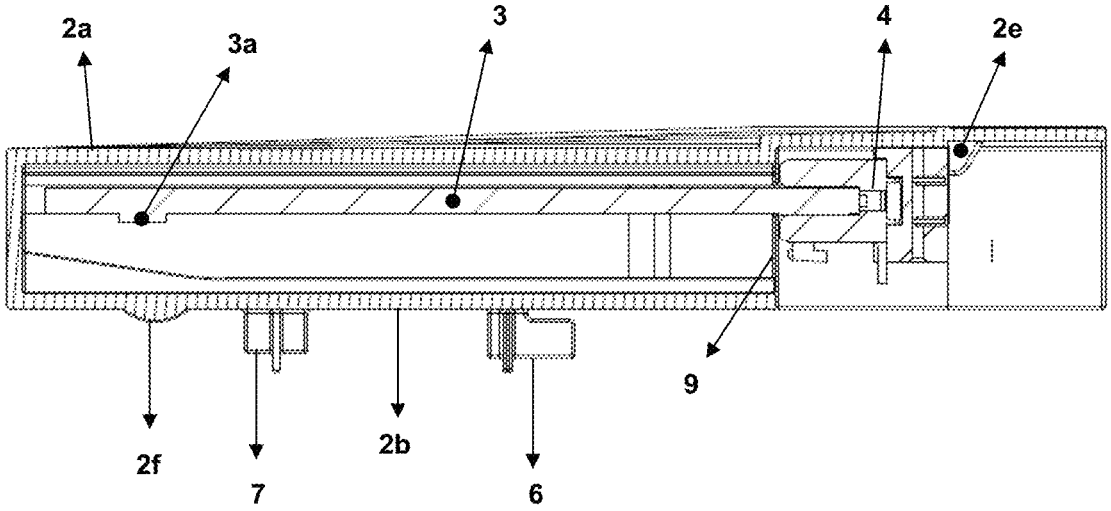
Figure – 6
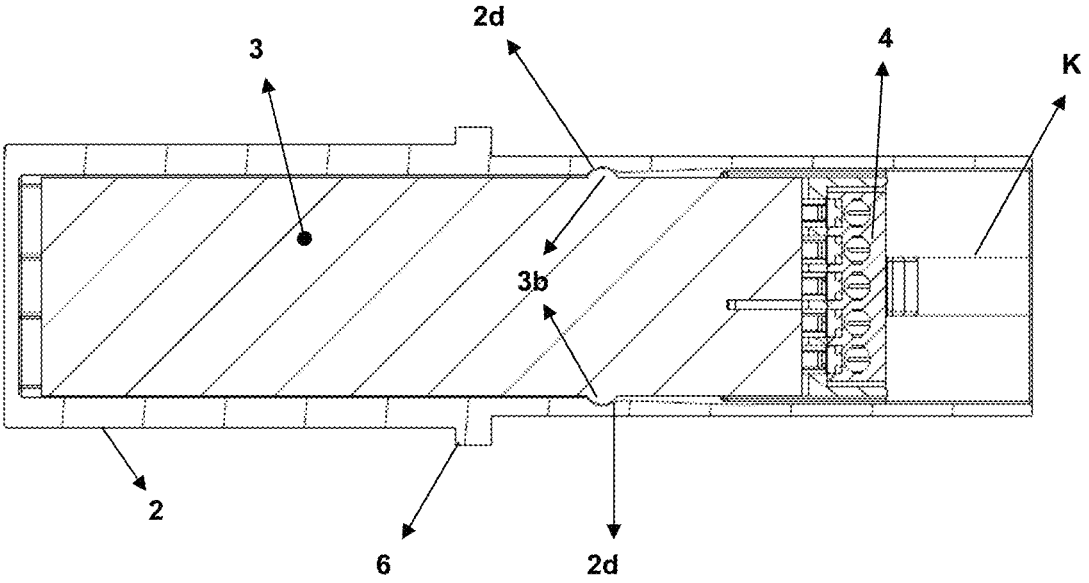
Figure – 7
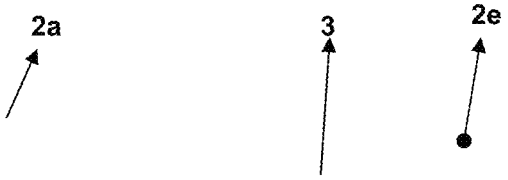

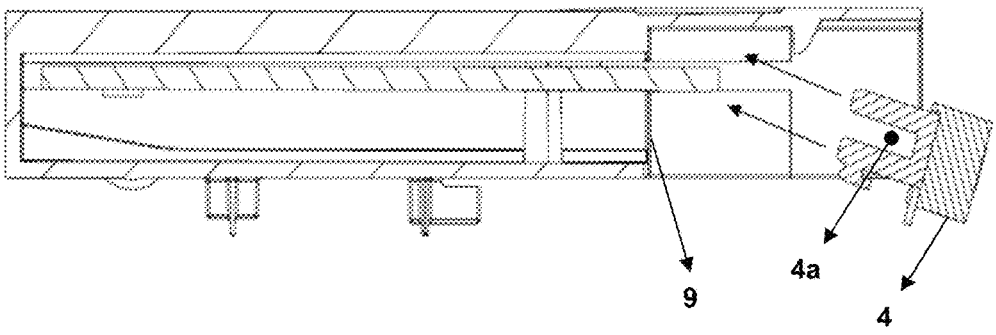
Figure – 8A
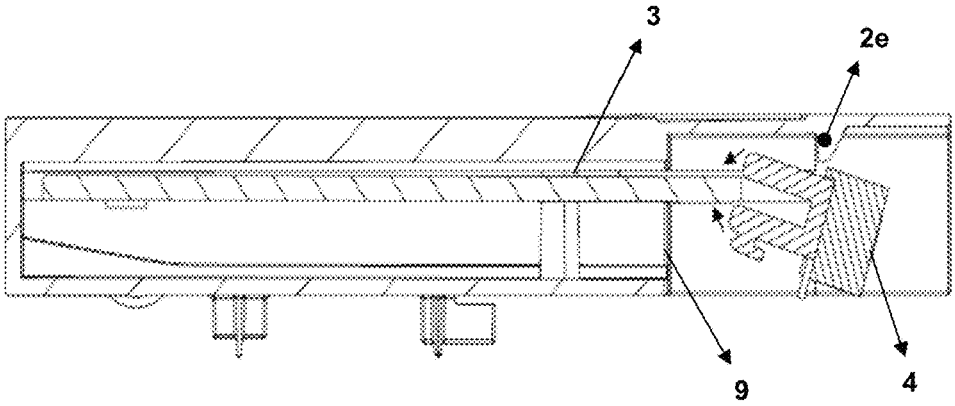
Figure – 8B
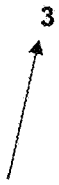

INFORMATION LIGHT SYSTEM AND A DISHWASHER COMPRISING THE SAME

CROSS-REFERENCE TO RELATED APPLICATIONS

This application claims priority to Turkish application 201/12134, filed Aug. 8, 2019, which is hereby incorporated by reference in its entirety.

TECHNICAL FIELD

The present invention relates to an information light system suitable for use in electronic household appliances, especially in dishwashers, to inform users about operating status of the household appliance, and an electronic household appliance comprising the same, in particular a dishwasher.

BACKGROUND OF THE INVENTION

In today's technology, there are various electronic household appliances used to carry out housework easily and to save both time and energy. Among these household appliances, especially dishwashers have become an essential part of daily lives by saving both time, water and energy. Having capability of allowing a large number of different dishes to be washed simultaneously, these dishwashers comprise a main body; a washing compartment located in the main body; a door controlling access into the washing compartment; a kick plate sheet placed at an area between the door and the main body; washing baskets for receiving the dishes to be washed, wherein the washing baskets are provided at the washing compartment for cleaning process and has a grid form for allowing the water inside the washing compartment to reach dishes; and at least one control unit which controls and adjusts operation of the dishwasher. Currently, dishwashing programmes of dishwashers consist of at least three stages: washing, rinsing and drying. In these dishwashers, washing and rinsing processes cause noise, even slightly. However, dishwasher does not make noise during drying process. Many users assume that dishwashing programme is completed when noise from the dishwasher while operating ceases, and open the dishwasher door to place the cleaned dishes or to dry the washed dishes quickly. This may lead water stains to remain on the dishes that are cleaned.

Moreover, especially for built-in dishwashers with silent operating technology, users cannot fully understand when the dishwashing programme started/ended without opening the door of the dishwasher or checking wetness of the dishes. Considering that washing and/or rinsing processes in dishwashers are carried out at high temperatures (50-70° C.), the user may be exposed to a high temperature steam while opening the door during or after washing or rinsing processes. This may disturb the user and cause unfavourable conditions, such as skin burns. Furthermore, in case the user rushes to place the dishes, fingers of the user can be damaged as he/she touches the dishes at high temperatures. In some cases, this may also cause the user to reflexively throw the dishes, which may cause glass/porcelain pieces to be broken.

Known art includes various applications for solving said problems, one of which is disclosed in the published patent document no. U.S. Pat. No. 9,161,675B2. Application disclosed in said patent document describes a device which reflects light onto a surface for allowing a user to detect whether the household appliance is operating or not. The device comprises a light source; a light guide which is placed at the door of the household appliance, wherein the light source is connected to at least one end of the light guide; and a window placed at a side of the door of the household appliance which is close to floor and parallel thereto, in order to reflect the light from the light guide onto the floor. However, in said application, since light source and light guide are mounted directly to the door, if the device is used in a household appliance, such as a dishwasher, running with water, electrical connections of the light guide may not be protected in case of a water leakage in the dishwasher, and this may cause the device to malfunction and even damage to the household appliance itself and/or electrical installation thereof. In addition, the elements in the device and/or the white appliance which are damaged should be replaced, which causes extra cost for the user.

BRIEF DESCRIPTION OF THE INVENTION

The present invention relates to an information light system which provides the user with information about operation of an electronic household appliance, especially a dishwasher, without requiring opening the door of the household appliance, and a dishwasher comprising the same. The information light system comprises:

- at least one electronic board which has at least one lighting element thereon, adapted to communicate with a control unit of the dishwasher, and adjusts operation of the lighting element according to data received from the control unit;
- at least one chamber which comprises at least a first wall and at least two second walls located facing each other, wherein at least one of the two second walls is connected to a first side of the first wall and at least the other one of the two second walls is connected to a side of the first wall opposite to the first side, with an angle other than 0 and 180 degrees in between, wherein the chamber is in the form of a housing suitable for placing the electronic board, is adapted to be mounted on a first surface from a side opposite thereof to the first wall, and enables light to be reflected onto a second surface which is opposite to the first surface;
- at least one cover which is located opposite to the first wall, covers at least partially the chamber and comprises at least one reflecting area which is light-transparent, has a form focusing the light emitted from the lighting element, and is located such that light emitted from the lighting element can reach, wherein a light focusing element is located on the reflecting area;
- at least one connector for energising the electronic board and which is located at the chamber, wherein the electronic board is connected to at least one side of the connector and a bunch of cables in connection with the control unit is connected to at least another side of the connector; and
- at least one flap which is located on the first wall and at an outer surface of the first fall not facing the chamber so as to be at the same side with the connector, directs a liquid coming onto the chamber away from the first wall of the chamber, thus preventing the water from leaking into the chamber in which the electronic board is fixed, and is connected from at least one side to the chamber in an inclined manner in such a way that it can direct the liquid coming to the chamber away from the first wall.

The dishwasher, on the other hand, comprises at least one main body; at least one washing compartment located in the main body; a door controlling access into the washing compartment; an information light system according to the description above; a control unit which generates at least one signal for adjusting operation of the lighting element, the signal being transmitted to the electronic board by the bunch of cables and the connector and comprising information about operating status of the dishwasher, wherein a side of the bunch of cables which is in connection with the connector is connected to the control unit; and a kick plate sheet which is located at an area between the door and the main body and comprises:

at least one plate connected to the main body parallel to a floor on which the dishwasher is located and having an upper surface and a lower surface, at least a first connection element to which a second connection part provided at the information light system is inserted such that the lower surface is pressed, at least a second connection element to which the first connection part is inserted so as to press the lower surface together with the first part of the first connection part.

Thanks to the information light system and the dishwasher comprising the same according to the present invention, the user can be informed about operating status of the dishwasher by reflecting light on a floor, in particular the floor on which the dishwasher is located. Therefore, the user can obtain information about operating status of the dishwasher remotely, without opening the door of the dishwasher or being exposed to hot steam.

OBJECT OF THE INVENTION

An object of the present invention is to provide an information light system which reflects light to a floor to provide the user with information about the operating status of an electronic household appliance, especially a dishwasher, in which it is provided; and a dishwasher comprising the same.

Another object of the present invention is to provide an information light system which, in case of a water leakage, prevents water from reaching electrical connections; and a dishwasher comprising the same.

A further object of the present invention is to provide an easy-to-use, practical, reliable and long-lasting information light system; and a dishwasher comprising the same.

DESCRIPTION OF THE DRAWINGS

Exemplary embodiments of the information light system and the dishwasher comprising the same according to the present invention are illustrated in the attached drawings, in which:

FIG. 6 is a side-sectional view of the developed information light system.

FIG. 7 is a top-sectional view of the developed information light system.

FIG. 8A is a side-sectional view of the developed information light system before placing the connector.

FIG. 8B is a side-sectional view of the developed information light system while placing the connector.

Figure 1:
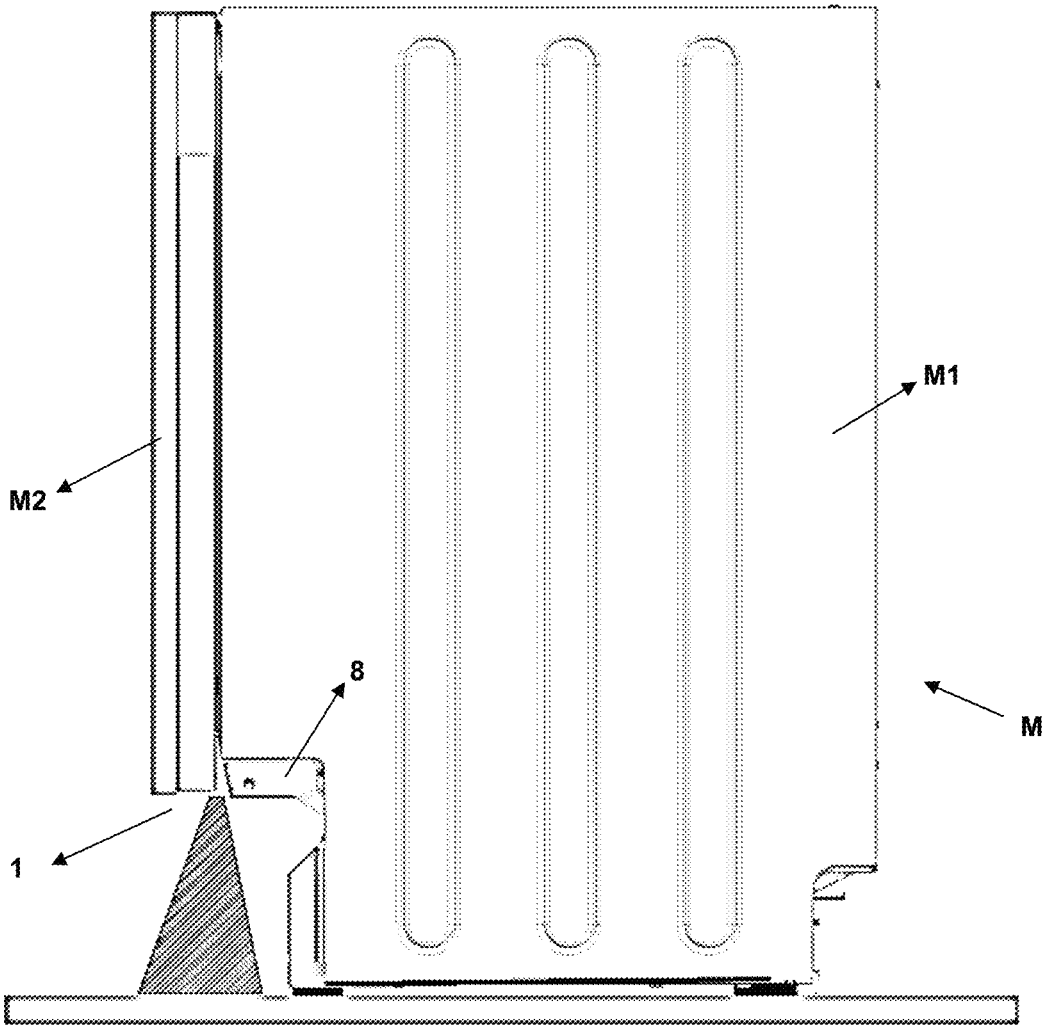
FIG. 1 is a side view of an exemplary use of the developed information light system in a dishwasher.

All the parts illustrated in figures are individually assigned a reference numeral and the corresponding terms of these numbers are listed below:

| | |
|---|---|
| Information light system | (1) |
| Chamber | (2) |
| First wall | (2a) |
| Cover | (2b) |
| Second wall | (2c) |
| First connection area | (2d) |
| First tab | (2e) |
| Reflecting area | (2f) |
| Electronic board | (3) |
| Lighting element | (3a) |
| Second connection area | (3b) |
| Connector | (4) |
| Connection slot | (4a) |
| Flap | (5) |
| First connection part | (6) |
| Second connection part | (7) |
| Kick plate sheet | (8) |
| Upper surface | (8a) |
| Lower surface | (8b) |
| Channel | (8c) |
| First connection element | (8d) |
| Second connection element | (8e) |
| Third wall | (9) |
| Detail | (A) |
| Bunch of cables | (K) |
| Main body | (M1) |
| Door | (M2) |

DESCRIPTION OF THE INVENTION

Dishwashers, one of the electronic household appliances, have become an essential part of daily lives by saving both time, water and energy. Currently, dishwashing programmes of dishwashers consist of at least three stages: washing, rinsing and drying. In these dishwashers, although washing and rinsing processes cause noise even slightly, the drying process does not. Many users assume that dishwashing programme is completed when noise from the dishwasher while operating ceases, and open the dishwasher door to place the cleaned dishes or to dry the washed dishes quickly. This may cause non-completion of the dishwashing programme, as well as causing water stains to remain on the dishes which are cleaned. In addition, as washing and/or rinsing processes are carried out at high temperatures (50-70° C.), the user may be exposed to a high temperature steam while opening the door during or after washing or rinsing processes. Moreover, especially for built-in dishwashers with silent operating technology, it cannot be fully understood when the dishwashing programme is started and/or ended without opening the door of the dishwasher. All these situations may disturb users and cause unfavourable conditions, such as skin burns. Furthermore, users can get burnt when they hold hot dishes and reflexively drop the dishes. This may cause glass/porcelain pieces to scatter around. Within this context, in order to solve said problems, there are provided an information light system which provides the user with information about operation of an electronic household appliance, especially a dishwasher, without requiring opening the door of the household appliance; and a dishwasher comprising the same.

An information light system (1) according to the present invention, as illustrated in FIGS. 4-8C, comprises:

at least one electronic board (3) which has at least one lighting element (3*a*) thereon, adapted to communicate with a control unit of the dishwasher, and adjusts operation of the lighting element (3*a*) according to data received from the control unit;

at least one chamber (2) which comprises at least a first wall (2*a*) and at least two second walls (2*c*) located facing each other, wherein at least one of the two second walls (2*c*) is connected to a first side of the first wall (2*a*) and at least the other one of the two second walls (2*c*) is connected to a side of the first wall (2*a*) opposite to the first side, with an angle other than 0 and 180 degrees in between, preferably with a substantially right angle, i.e. which are side walls, wherein the chamber (2) is in the form of a housing (formed by junction of the first wall (2*a*) and the second walls (2*c*)) suitable for placing the electronic board (3), is adapted to be mounted on a first surface (e.g. on a kick plate sheet of the dishwasher) from a side thereof opposite to the first wall (2*a*), and enables light to be reflected onto a second surface, preferably a floor, which is opposite to the first surface (i.e. when the chamber (2) is mounted on the first surface, the first surface remains between the chamber (2) and the second surface);

at least one cover (2*b*) which is located opposite to the first wall (2*a*), covers at least partially the chamber (2) and comprises at least one reflecting area (2*f*) which is light-transparent (i.e. has a permeability that allows light from the lighting element (3*a*) to be visible on said second surface), has a form focusing the light emitted from the lighting element (3*a*) (preferably, convex), and is preferably located substantially directly opposite to the lighting element (3*a*) such that light emitted from the lighting element (3*a*) can reach, wherein a light focusing element, preferably a lens, is located on the reflecting area;

at least one connector (4) for energising the electronic board (3) and which is located at the chamber (2), preferably way from the first wall (2*a*) with a first distance a, and preferably comprises at least one connection slot (4*a*), wherein the electronic board (3) is connected to at least one side of the connector (4) preferably by being inserted into the connection slot (4*a*) and a bunch of cables (K) in connection with the control unit is connected to at least another side of the connector (4); and at least one flap (5) which is located on the first wall (2*a*) and at an outer surface of the first fall (2*a*) not facing the chamber (2) (i.e. a surface of the first wall (2*a*) not facing the cover (2*b*)) so as to be at the same side with the connector (4), directs a liquid (e.g. a cleaning liquid by which dishes in the dishwasher are cleaned) coming onto the chamber (2) away from the first wall (2*a*) of the chamber (2), thus preventing the water from leaking into the chamber (2) in which the electronic board (3) is fixed, and is connected from at least one side to the chamber (2) in an inclined manner in such a way that it can direct the liquid coming to the chamber (2) away from the first wall (2*a*) (e.g. connected to the chamber from a side closest to the second wall (2*c*) and inclined towards the second wall (2*c*) so as to have a distance between the side closest to the second wall (2*c*) and the first fall (2*a*)).

In a preferred embodiment of the information light system (1) according to the present invention, the chamber (2) narrows from one end towards another end where the flaps (5) are provided.

In a preferred embodiment, the information light system (1) according to the present invention comprises at least a first connection area (2*d*) in the form of a protrusion and/or recess which is located at inner surface of the second wall (2*c*) facing the chamber (2), and at least a second connection area (3*b*) in the form of a protrusion and/or recess (for example, if the first connection area (2*d*) is a protrusion, the second connection area (3*b*) is a recess receiving said protrusion and/or if the first connection area (2*d*) is a recess, the second connection area (3*b*) is a protrusion inserted into said protrusion) which is located at the electronic board (3) and is connected to the first connection area (2*d*), preferably by close fit manner, when the electronic board (3) is positioned in the chamber (2). Therefore, electronic board (3) can be prevented from moving unintentionally inside the chamber (2).

In another preferred embodiment of the invention, the information light system (1) comprises at least a first tab (2*e*) preferably in the form of a protrusion extending downward from the first wall (2*a*), the first tab (2*e*) being located in the chamber (2) and supporting, when the electronic board (3) is connected to one side of the connector (4), another opposite side of the connector (4) so as to prevent connector (4) from displacing. The information light system (1) according to said embodiment also preferably comprises at least a third wall (9) which is located inside the chamber (2), at a side of the chamber (2) where the flaps (5) are provided (i.e. in the housing of the chamber (2)), supports the connector (4) from opposite sides together with the first tab (2*e*), thus enabling the connector (4) to be pressed between the third wall (9) and the first tab (2*e*) for preventing unintentional movement of the connector (4), wherein at least one opening is provided on the third wall (9) such that the electronic board (3) is passed through to hold the electronic board (3) in a balanced manner.

In an alternative embodiment, the information light system (1) according to the invention preferably comprises at least a first connection part (6) for mounting the chamber (2) to the first surface and which comprises at least a first part extending substantially parallel to the side of the second wall (2*c*) that intersects the cover (2*b*) and at least a second part which is in connection with the first part so as to have an angle different from 0 and 180 degrees in between (preferably with an end of the first part), preferably substantially right angle, preferably to form a substantially "L" form, wherein at least one section of the second part in connection with the first part and located on the second wall (2*c*) extends away from the chamber (2) (thus, the cover), from a surface of the chamber (2) on which the cover (2*b*) is provided (e.g. such that the first part is inserted into a channel in the form of a hole on the first surface and settled on, preferably in contact with, the side of the first surface facing the second surface; and that the first surface is pressed between the second wall (2*c*) and the first part).

In a preferred embodiment of the information light system (1) according to the present invention, the information light system (1) comprises at least a second connection part (7) which is preferably in connection with the cover (2*b*), extends from the second wall (2*c*) away from the chamber (2) and is located at the chamber (2) so as to have an angle with the second wall (2*c*) different from 0 and 180 degrees, preferably substantially a right angle.

In a preferred embodiment of the information light system (1) according to the present invention, said first distance is at least 5 mm (said first distance being the distance between the connector (4) and the first wall). Therefore, the connector (4) is prevented from getting wet in case of a liquid leakage.

In an alternative embodiment of the information light system (1) according to the present invention, there are provided a plurality of lighting elements (3*a*) located on the electronic board (3), wherein these lighting elements (3*a*) preferably emit different colours of light (such as red, green, blue, white). These lighting elements (3*a*) can, for example, reflect a different colour of light to said floor in each step to show the different stages of the dishwasher to the user.

Figure 2:
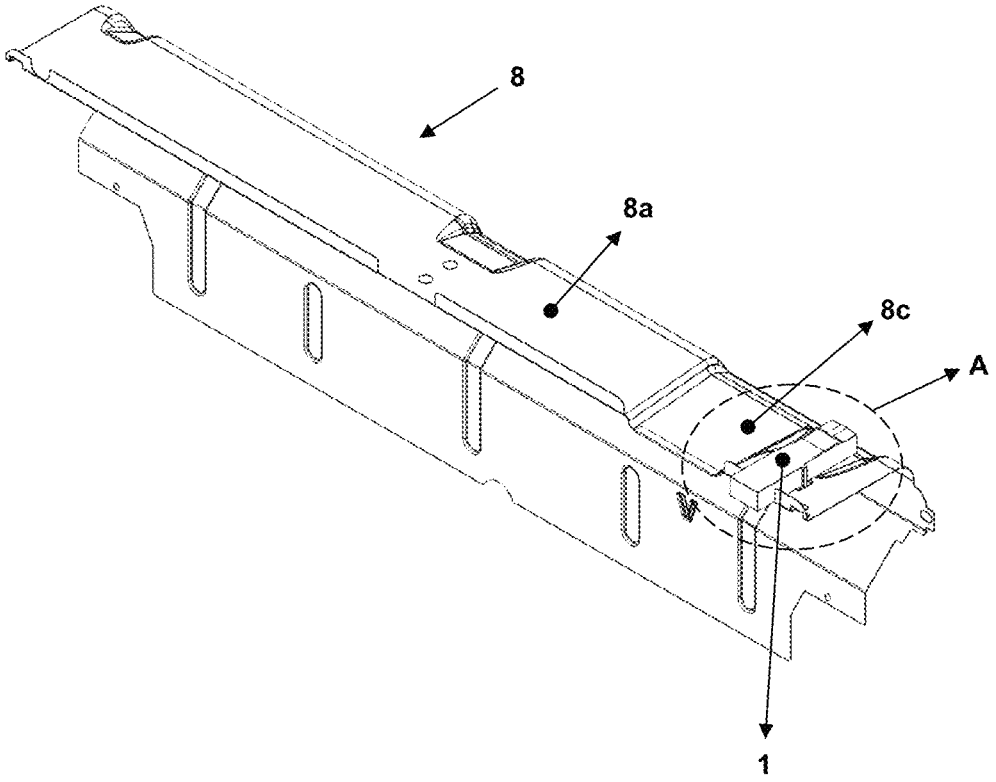
FIG. 2 is a perspective view of a kick plate sheet of the dishwasher in which the developed information light system is provided.
Figure 3:
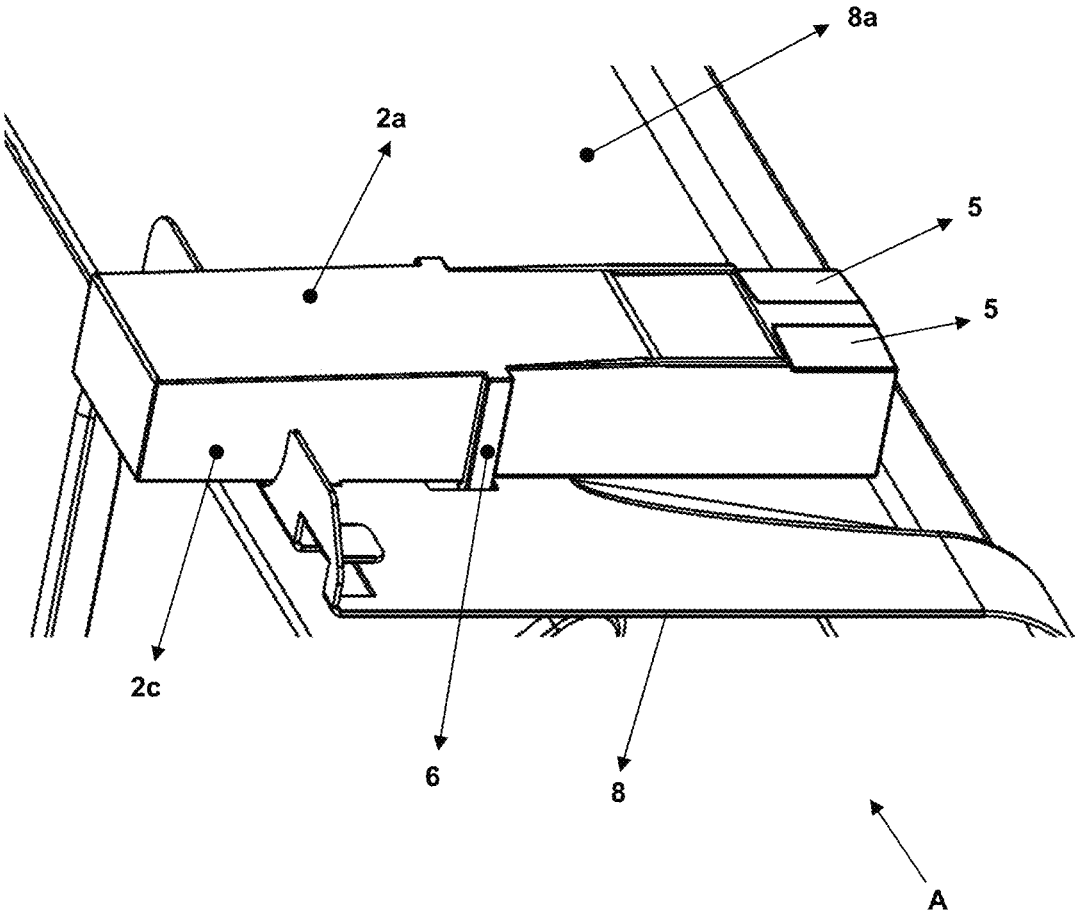
FIG. 3 is a view of the detail "A" of FIG. 2.
Figure 4:
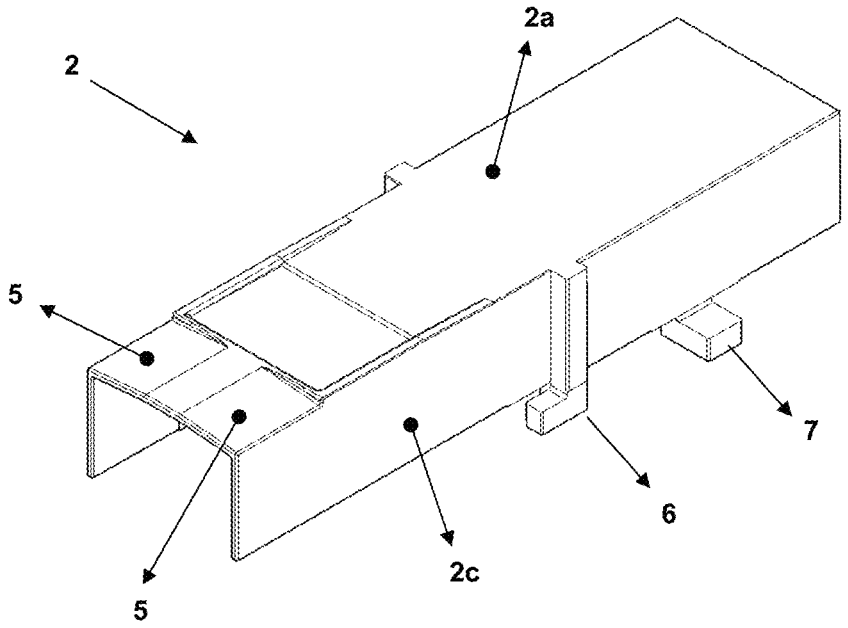
FIG. 4 is a perspective view of the developed information light system.
Figure 5:
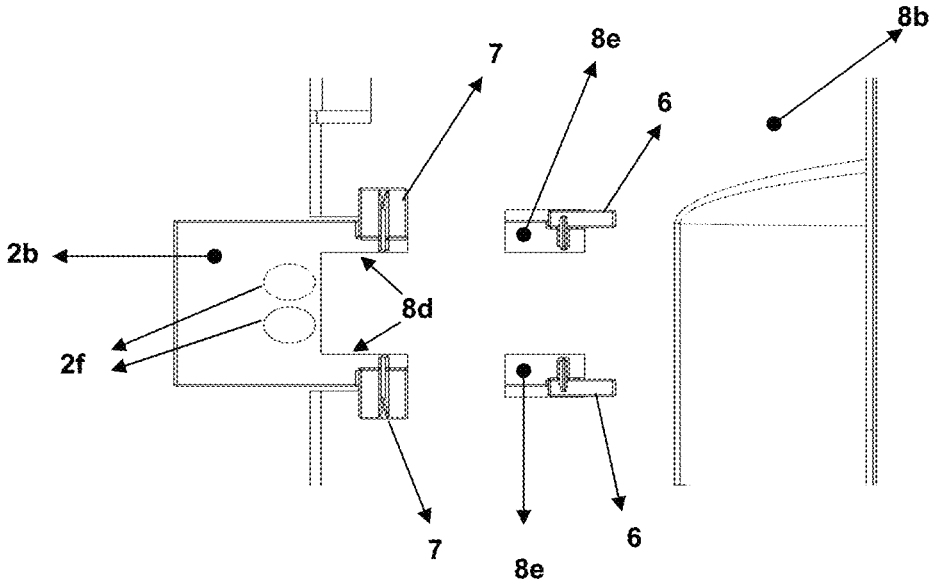
FIG. 5 is a bottom view of the developed information light system mounted on the kick plate sheet.
Figure 8C:
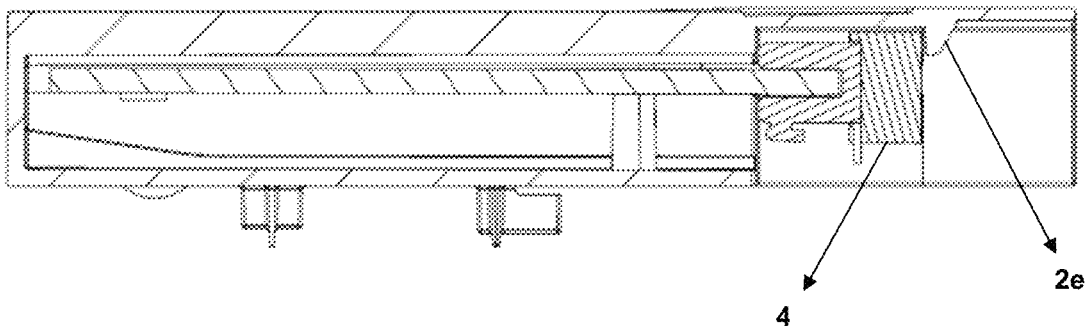
FIG. 8C is a side-sectional view of the developed information light system after placing the connector.

The dishwasher (M) according to the present invention, as illustrated in FIGS. 1-3, comprising at least one main body (M1); at least washing compartment located in the main body (M1); and a door (M2) controlling access into the washing compartment comprises said information light system (1); a control unit (not shown in the figures) which generates at least one signal for adjusting operation of the lighting element (3*a*), the signal being transmitted to the electronic board (3) by the bunch of cables (K) and the connector (4) and comprising information about operating status of the dishwasher, wherein a side of the bunch of cables (K) which is in connection with the connector (4) is connected to the control unit; and a kick plate sheet (8) which is located at an area between the door (M2) and the main body (M1) and comprises:

at least one plate connected to the main body (M1) parallel to a floor on which the dishwasher is located (i.e. to the second surface) and having an upper surface (8*a*) and a lower surface (8*b*), at least a first connection element (8*d*) preferably in the form of a channel to which a second connection part (7) provided at the information light system (1) is inserted such that the lower surface (8*b*) is pressed, at least a second connection element (8*e*) preferably in the form of a hole to which the first connection part (6) is inserted so as to press the lower surface (8*b*) together with the first part of the first connection part (6).

In an exemplary embodiment of the dishwasher (M) comprising the information light system (1) of the present invention, when the user activates the dishwasher (M) and initiates a dishwashing programme, the control unit generates a signal and transmits this signal to the electronic board (3) by means of the connector (4). Then, the electronic board (3) activates the lighting element (3*a*) based on incoming signal data. Light emitted by the lighting element (3*a*) is focused by the light focusing element provided at the reflecting area (2*f*) and is passed through the reflecting area (2*f*) to be reflected onto the floor (second surface) on which the dishwasher (M) is provided. Therefore, the user acquires information about operating status of the dishwasher (M) without opening door (M2) of the dishwasher (M).

In a preferred embodiment of the dishwasher (M) according to the present invention, the dishwasher (M) comprises at least one channel (8*c*) which is inclined towards the connector (4) and located at a side of the plate at which the chamber (2) is provided. Therefore, in case of a liquid leakage, the chamber and the electronic board (3) and the connector (4) inside the chamber (2) are prevented from getting wet.

Thanks to the information light system (1) and the dishwasher (M) comprising the same according to the present invention, the user can be informed about operating status of the dishwasher (M) by reflecting light on a floor, in particular the floor on which the dishwasher (M) is provided. Therefore, the user can obtain information about operating status of the dishwasher (M) remotely, without opening the door (M2) of the dishwasher (M) or being exposed to hot steam.

The invention claimed is:

1. An information light system (1), comprising:

at least one electronic board (3) which has at least one lighting element (3*a*) thereon, adapted to communicate with a control unit of the dishwasher, and adjusts operation of the lighting element (3*a*) according to data received from the control unit;

at least one chamber (2) which comprises at least a first wall (2*a*) and at least two second walls (2*c*) located facing each other, wherein at least one of the two second walls (2*c*) is connected to a first side of the first wall (2*a*) and at least the other one of the two second walls (2*c*) is connected to a side of the first wall (2*a*) opposite to the first side, with an angle other than 0 and 180 degrees in between, wherein the chamber (2) is in the form of a housing suitable for placing the electronic board (3), is adapted to be mounted on a first surface from a side thereof opposite to the first wall (2*a*), and enables light to be reflected onto a second surface which is opposite to the first surface;

at least one cover (2*b*) which is located opposite to the first wall (2*a*), covers at least partially the chamber (2) and comprises at least one reflecting area (2*f*) which is light-transparent, has a form focusing the light emitted from the lighting element (3*a*), and is located such that light emitted from the lighting element (3*a*) can reach, wherein a light focusing element is located on the reflecting area;

at least one connector (4) for energising the electronic board (3) and which is located at the chamber (2), wherein the electronic board (3) is connected to at least one side of the connector (4) and a bunch of cables (K) in connection with the control unit is connected to at least another side of the connector (4); and at least one flap (5) which is located on the first wall (2*a*) and at an outer surface of the first fall (2*a*) not facing the chamber (2) so as to be at the same side with the connector (4), directs a liquid coming onto the chamber (2) away from the first wall (2*a*) of the chamber (2), thus preventing the water from leaking into the chamber (2) in which the electronic board (3) is fixed, and is connected from at least one side to the chamber (2) in an inclined manner in such a way that it can direct the liquid coming to the chamber (2) away from the first wall (2*a*).

2. An information light system (1) according to claim 1, wherein the information light system (1) comprises at least a first connection area (2*d*) in the form of a protrusion and/or recess which is located at an inner surface of the second wall (2*c*) facing the chamber (2), and at least a second connection area (3*b*) in the form of a protrusion and/or recess which is located at the electronic board (3).

3. An information light system (1) according to claim 1, wherein the information light system (1) comprises at least a first tab (2*e*) in the form of a protrusion extending downward from the first wall (2*a*), the first tab (2*e*) being located in the chamber (2) and supporting, when the electronic board (3) is connected to one side of the connector (4), another opposite side of the connector (4) so as to prevent connector (4) from displacing.

4. An information light system (1) according to claim 1, wherein one side of the connector (4) comprises at least one connection slot (4*a*) to which the electronic board (3) is connected by being inserted.

5. An information light system (1) according to claim 1, wherein the information light system (1) comprises at least a third wall (9) which is located inside the chamber (2), at a side of the chamber (2) where the flaps (5) are provided, supports the connector (4) from opposite sides together with the first tab (2*e*), thus enabling the connector (4) to be pressed between the third wall (9) and the first tab (2*e*) for preventing unintentional movement of the connector (4), wherein at least one opening is provided on the third wall (9) such that the electronic board (3) is passed through to hold the electronic board (3) in a balanced manner.

6. An information light system (1) according to claim 1, wherein the information light system (1) comprises at least a first connection part (6) for mounting the chamber (2) to the first surface and which comprises at least a first part extending substantially parallel to the side of the second wall (2*c*) that intersects the cover (2*b*) and at least a second part which is in connection with the first part so as to have an angle different from 0 and 180 degrees in between, wherein at least one section of the second part in connection with the first part and located on the second wall (2*c*) extends away from the chamber (2), from a surface of the chamber (2) on which the cover (2*b*) is provided.

7. An information light system (1) according to claim 1, wherein the information light system (1) comprise at least a second connection part (7) which extends from the second wall (2*c*) away from the chamber (2) and is located at the chamber (2) so as to have an angle with the second wall (2*c*) different from 0 and 180 degrees.

8. An information light system (1) according to claim 1, wherein the reflecting area (2*f*) is located substantially directly opposite to the lighting element (3*a*).

9. An information light system (1) according to claim 1, wherein the reflecting area (2*f*) is convex.

10. An information light system (1) according to claim 1, wherein the connector (4) is located away from the first wall (2*a*) with a first distance.

11. An information light system (1) according to claim 1 wherein said first distance is at least 5 mm.

12. An information light system (1) according to claim 1, wherein the second part is connected to the first part to form a substantially "L" form.

13. A dishwasher (M) including a main body (M1), a washing compartment located in the main body (M1), a door (M2) controlling access into the washing compartment, and an information light system (1) according to claim 1, further comprising:

a control unit which generates at least one signal for adjusting operation of the lighting element (3*a*), the signal being transmitted to the electronic board (3) by the bunch of cables (K) and the connector (4) and comprising information about operating status of the dishwasher, wherein a side of the bunch of cables (K) which is in connection with the connector (4) is connected to the control unit; and a kick plate sheet (8) which is located at an area between the door (M2) and the main body (M1) and comprises:

at least one plate connected to the main body (M1) parallel to a floor on which the dishwasher is located and having an upper surface (8*a*) and a lower surface (8*b*), at least a first connection element (8*d*) to which a second connection part (7) provided at the information light system (1) is inserted such that the lower surface (8*b*) is pressed, at least a second connection element (8*e*) to which the first connection part (6) is inserted so as to press the lower surface (8*b*) together with the first part of the first connection part (6).

14. A dishwasher (M) according to claim 13, wherein the dishwasher (M) comprises at least one channel (8*c*) which is inclined towards the connector (4) and located at a side of the plate at which the chamber (2) is provided.

15. A dishwasher (M) according to claim 13, wherein the first connection element (8*d*) is in the form of a channel and/or the second connection element (8*e*) is in the form of a hole.

* * * * *